US005673442A

United States Patent [19]

Westlund

[11] Patent Number: 5,673,442

[45] Date of Patent: Oct. 7, 1997

[54] COVER FOR SWIMMING POOLS

[76] Inventor: Stig Westlund, Carlgrensvag 70, S-892 30, Domsjo, Sweden

[21] Appl. No.: 545,638

[22] PCT Filed: Apr. 29, 1994

[86] PCT No.: PCT/SE94/00390

§ 371 Date: May 5, 1996

§ 102(e) Date: Mar. 5, 1996

[87] PCT Pub. No.: WO94/25707

PCT Pub. Date: Nov. 10, 1994

[30] Foreign Application Priority Data

Apr. 30, 1993 [SE] Sweden ..... 9301488

[51] Int. Cl.[6] ..... E04H 4/00

[52] U.S. Cl. ..... 4/498; 4/500; 4/503

[58] Field of Search ..... 4/498, 499, 500, 4/502, 503

[56] References Cited

U.S. PATENT DOCUMENTS 3,008,148 11/1961 Vierling ..... 4/500

3,832,741 9/1974 Ward ..... 4/500

3,895,400 7/1975 Kelcey ..... 4/500

4,163,295 8/1979 Schutz .

4,853,985 8/1989 Perry ..... 4/498

FOREIGN PATENT DOCUMENTS 2750083 5/1979 Germany .

*Primary Examiner*—David J. Walczak

*Attorney, Agent, or Firm*—Cushman Darby & Cushman Intellectual Property Group of Pillsbury Madison & Sutro LLP

[57] ABSTRACT

A protection device for swimming pools and similar types of pools, which are provided with a surrounding pool edge, including a pool cover which can be pulled or folded out for covering the pool and be pulled, retracted or folded in for decovering the pool. The pool cover includes a first end portion which is connected to a first, elongated carrier, and a second, opposite end portion which is connected to a second, elongated carrier. The first carrier is fastened to a fundament, i.e., a base fixed at a position located outside the pool edge, whereas the second carrier is pivotally arranged at the first carrier so that the pool cover from a retracted position can be brought to cover the pool by pivoting out the second carrier in relation to the first carrier.

8 Claims, 5 Drawing Sheets

COVER FOR SWIMMING POOLS

BACKGROUND OF THE INVENTION

This invention relates to a protection device for swimming pools and similar types of pools, which are provided with a surrounding pool edge, the protection device comprising a pool cover which can be pulled or folded out for covering the pool and be pulled, retracted or folded in for uncovering the pool.

Nowadays there are requirements that swimming pools shall be protected when not used. The reason for that is that children shall be prevented from falling into the pool and from drowning. An essential advantage with a pool cover is partly that the vaporisation from the pool is reduced, partly that the wasteage of additives is prevented. Furthermore, the number of swimming pools has strongly increased lately. These facts taken together have had the consequence that the demand for pool cover has strongly risen.

From U.S. Pat. No. 3,008,148 is previously known a pool cover for protection of swimming pools having a circular design. The pool cover is intended to be folded out and folded in. However, the device has a very complicated construction. Thus, the pool cover shall be kept in place in the pool by means of a cylinder functioning as a ballast device and being intended to be placed on the bottom of the pool in its centre part. From this cylinder goes up an essentially vertical pipe which in its upper end is connected with the pool cover and keeps the same in place. When the pool shall be used, the cylinder-like lump and the pool cover have accordingly to be lifted away from the pool which is a very complicated measure. Due to that fact, the known pool cover has not had a great importance.

SUMMARY OF THE INVENTION

This invention intends to remove the problems with the known technique and to provide a pool cover which is very simple to fasten to the pool when the pool is not used and to take away from the pool when the pool shall be used. This has been made possible by a pool protection of the kind mentioned by way of introduction which is characterized by the combination of the following features:

The pool cover has a first end portion, which is connected to a first, elongated carrier provided with two end portions, and a second, opposite end portion which is connected to a second, elongated carrier, provided with two end portions.

The first carrier is fastened to and borne by a fundament which is positioned outside the pool edge.

The second carrier at its one end portion is pivotally journalled at the one end portion of the first carrier about an essentially vertical, first shaft so that the pool cover from a retracted position where the two carders are close to each other can be brought to cover the pool by pivoting out the second carrier in relation to the first one.

The second carrier has elongated, movement-facilitating means which are directed in the longitudinal direction of the carrier and which has such an extension that a part of the means will always be in contact with the edge surrounding the pool.

BRIEF DESCRIPTION OF THE DRAWINGS

Further features of the invention will appear more closely below in connection with the description of two preferred embodiments of the pool protection according to the invention. In this connection reference is made to the accompanying drawings, wherein:

Referring to FIGS. 1, 2 is shown there the pool cover 1 applied on an essentially round swimming pool 2. The pool cover 1 comprises two elongated carriers 3, 4, which, when the pool protection is in an inactive position, are arranged like a two-piece cassette with the one carrier 3 positioned above the other one 4.

Figure 1:
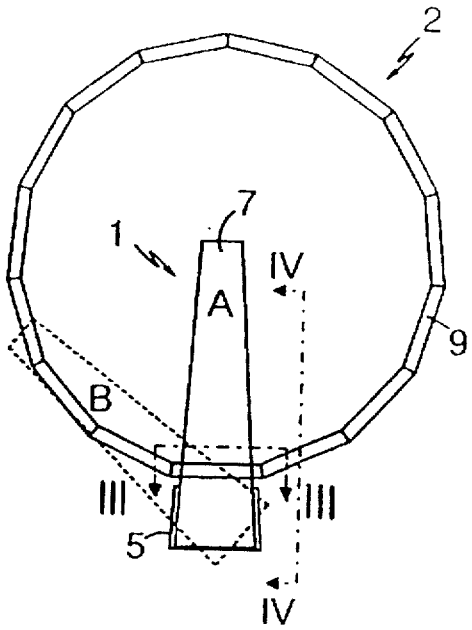
FIG. 1 shows a view from above of a first embodiment of the pool protection with the pool cover in an inactive position for an essentially round swimming pool, the pool edge surrounding the swimming pool comprising a pool border.

The cassette is fastened to and borne by a fundament 5 (i.e., a base) which is preferably fixed in the ground by casting just outside the pool itself. Furthermore, the cassette is pivotally journalled about an essentially vertical shaft 6 in the fundament so that it can take different positions in relation to this one, preferably an active position (indicated by A in FIG. 1) when the outer end of the cassette projects essentially to the mid portion of the pool, and an inactive position (indicated by B in FIG. 1) when the cassette is pivoted into the pool edge in order not to be an obstacle to those who use the swimming pool.

Figure 3:
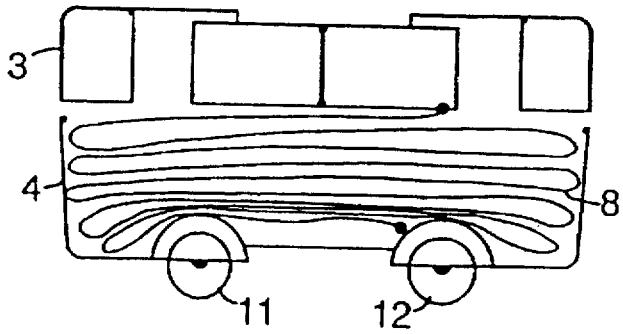
FIG. 3 shows a cross section of the pool protection, taken along the line III—III of FIG. 1.
Figure 2:
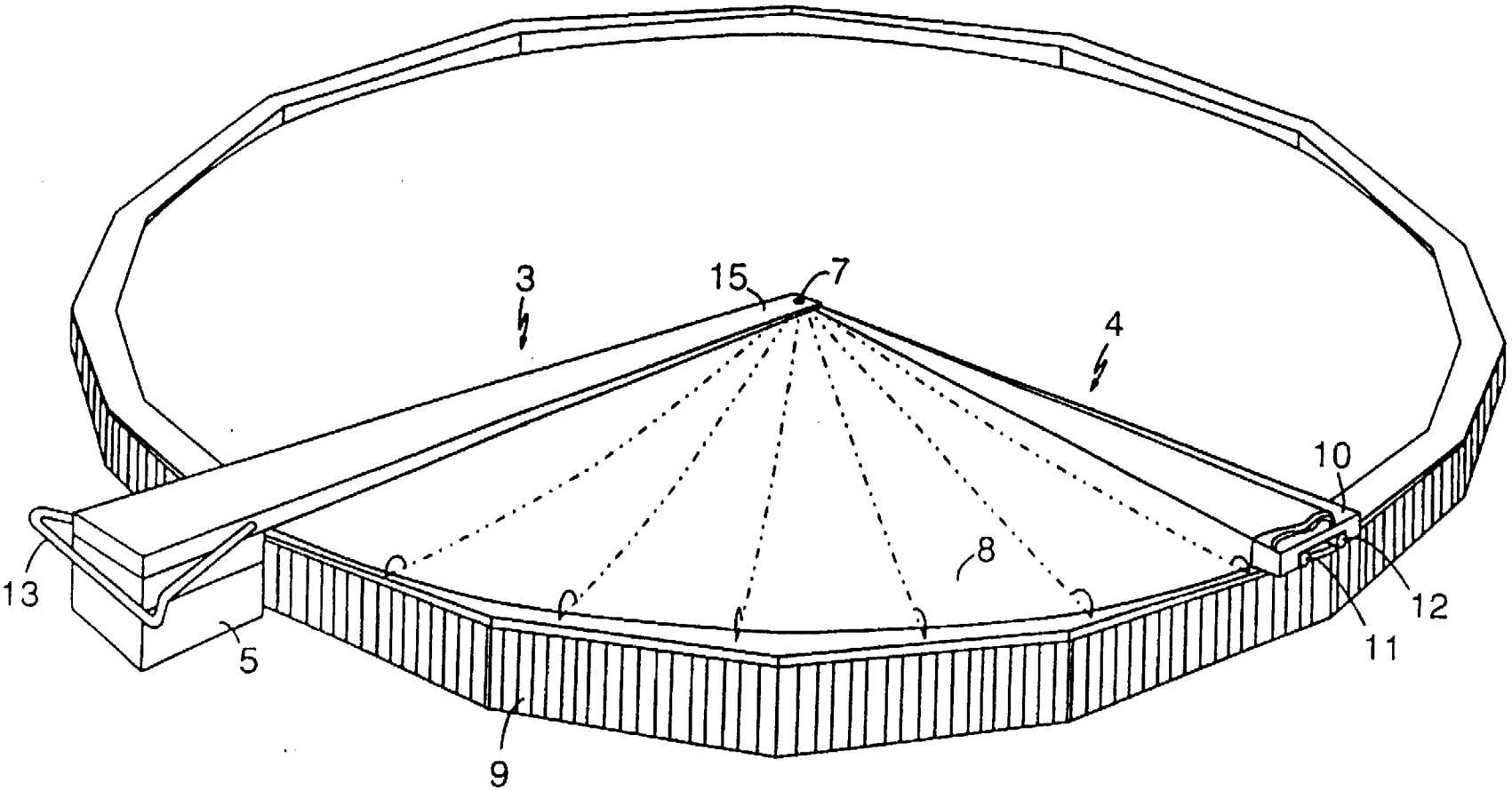
FIG. 2 shows a perspective view of the swimming pool with a pool protection, the pool cover being partly in an active position.

In FIG. 2 is shown the lower cassette part, i.e. the carrier 4 extracted from the upper cassette part, i.e. the carrier 3. In order that this shall be possible, the lower carrier 4 is pivotally arranged on the upper carrier 3 at the outer end portion of this one about an essentially vertical shaft 7. Furthermore, the lower carrier is box-shaped and is intended to contain the pool cover 8 itself (see FIG. 3), the one end of which is fastened to the upper carrier 3, whereas its other, opposite end is fastened to the lower carrier 4. The upper carrier 3 is preferably made of aluminium profiles, which overlap each other on their top sides, and has a design which narrows in the direction towards its free end.

As is shown in FIG. 2, the swimming pool has a surrounding border 9. On the top side of this border, the lower carrier 4 is intended to move when extracting the pool cover 8. In order to facilitate this movement, the end portion 10 of the lower carrier 4, intended to be in contact with the border 9, has two roller-like means 11, 12. These means 11, 12 are essentially parallel with the carrier 4 and have such a length that even if the pool is not completely round, for instance if it is kidney-shaped, they shall be in contact with the top side of the pool border 9. For this purpose, the length of the roller means shall be the same as the difference between the greatest and the least distance between the pool border and the centre of the pool.

Figure 4:
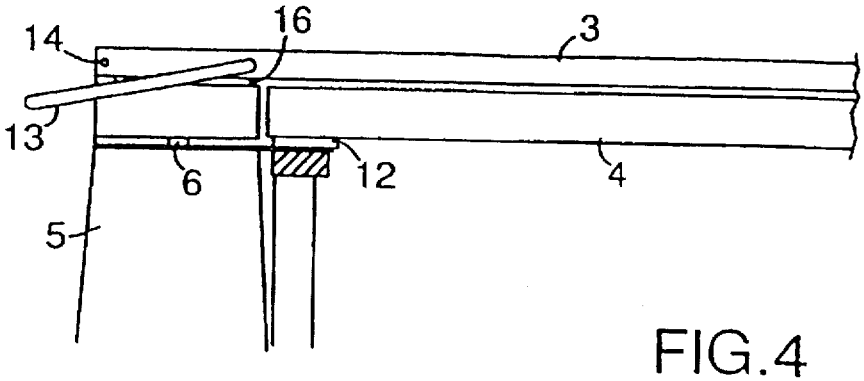
FIG. 4 shows a view of the pool protection according to FIG. 1, seen in the direction of the arrows IV—IV.

The pool protection is provided with a locking device 13, (see FIGS. 2, 4), which is designed like a handle, and by which the cassette can be locked in its active position in the centre of the pool and in its inactive position at the peripheral part of the pool. The inner end portion of the upper carrier 3 has a hinge-like fastening 14 in relation to the fundament 5. Due to that fact, a raising of the outer end portion 15 of the carrier 3 is made possible, when a pressure from below is applied onto the carrier 3 at the point 16 (see FIG. 4) by means of the locking device 13. This means that, when the pool cover 8 covers the pool 2, the outer end portion 15 of the carrier 3 brings the pool cover 8 at the centre of the pool with it, which has the positive effect that the drainage of rain water from the pool cover 8 is improved, whereby the rain water is prevented from streaming down into the pool.

Figure 5:
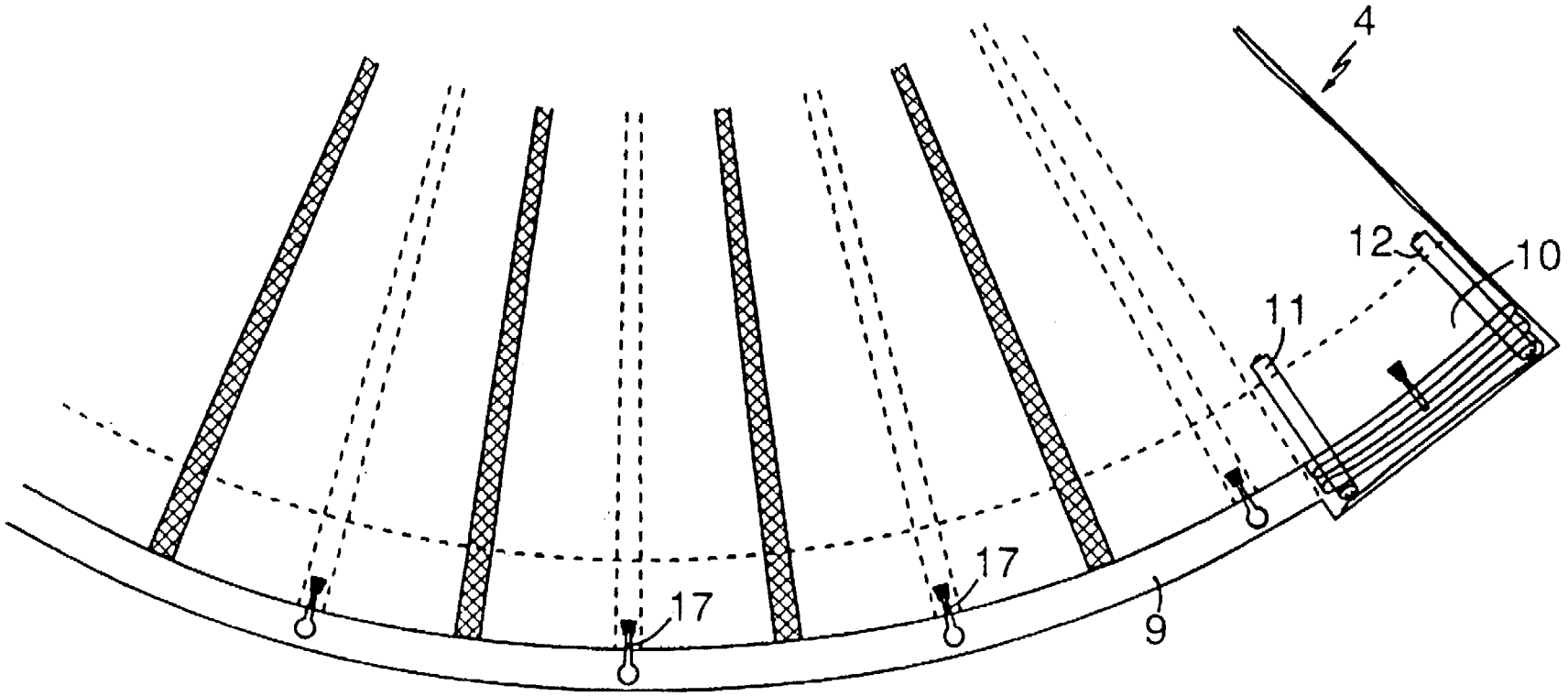
FIG. 5 shows a plurality of devices for fastening the pool cover to the border of the swimming pool.
Figure 6:
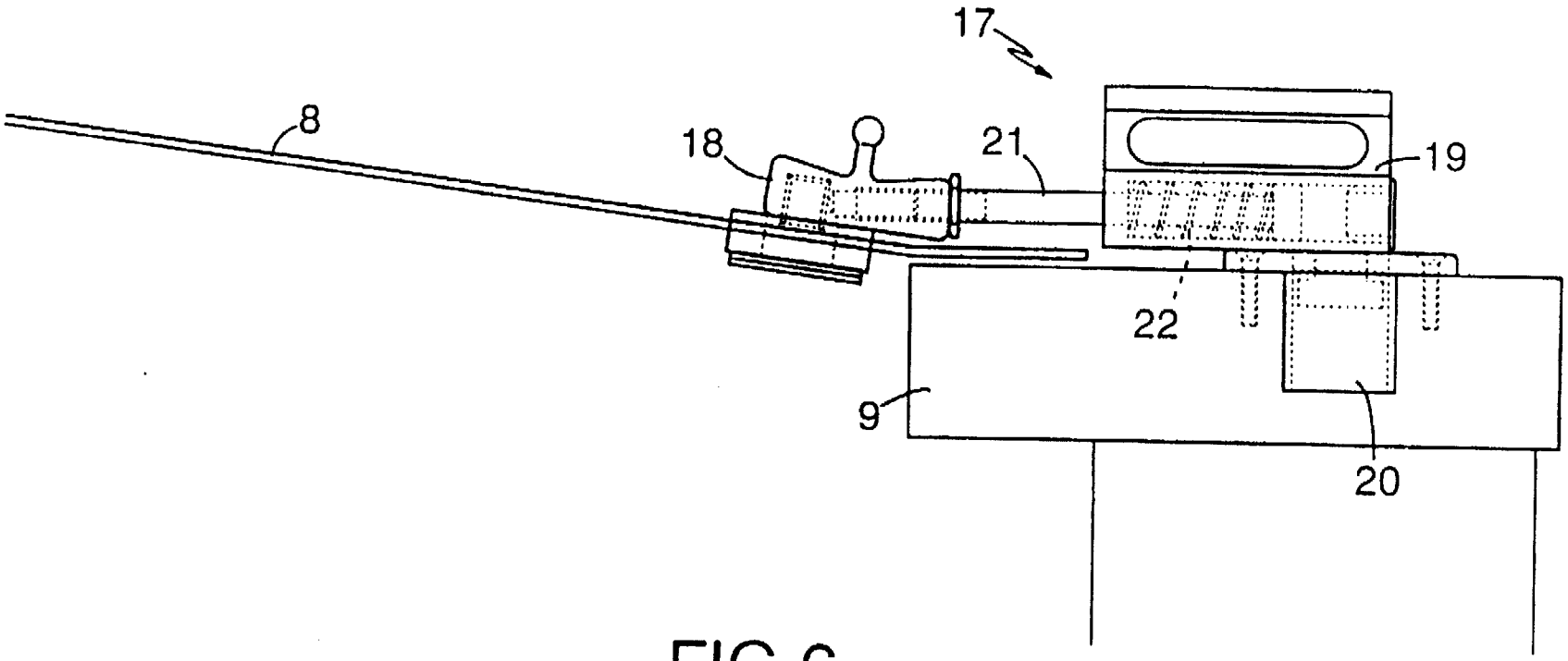
FIG. 6 shows a detailed illustration of a fastening device of the kind shown in FIG. 5.

As is apparent from FIGS. 5, 6, the pool protection comprises a great number of devices 17 for fastening the pool cover 8 to the pool border 9. Due to that fact it is possible to prevent, for instance, strong winds to catch the pool cover and to lift it up. These fastening devices 17 are positioned at a distance from each other around the periphery of the pool.

Each fastening device 17 comprises a first means 18 which is intended to be fastened in the pool cover 8 and a second means 19 which is intended to be fastened by hooking in a cavity 20 made in the upper part of the pool border 9. The two means 18, 19 are connected with each other by means of a bar 21 which is spring-loaded, whereby the means 18 has a possibility to get further away from the meads 19 against the action of the spring 22. This fact facilitates the raising of the pool cover 8, especially if the distance from the centre of the pool to the pool edge varies around the periphery of the pool, which, as has been mentionend previously, is made in order to facilitate the drainage of rain water.

When covering the swimming pool 2 the following steps are followed. In that connection, it is supposed that the two-piece cassette 3, 4 is placed in an inactive position at a peripheral part of the pool.

The cassette 3, 4 is pivoted out so that its free end portion ends up at the centre part of the swimming pool 2. In this connection, the upper carrier 3 is locked by means of the locking device 13. In this position, the lower carrier 4 is resting on the top side of the border 9 at its inner portion and is at its outer end connected with the outer end of the upper carrier 3 by means of the shaft 7, the lower carrier 4 being pivotally arranged in relation to the upper carrier about the mentioned shaft. Thereafter, the lower carrier 4 is pivoted out from its inactive position under the upper carrier 3. In this connection, the roller means roll on the top side of the border 9. At the same time, the pool cover 8 slides out from the lower carrier 4 and begins to cover the pool. The lower carrier 4 is rolled on the top side of the border 9 around the entire pool so that, after a turning of 360°, it ends up under the upper carrier 3. In this position, the entire pool 2 is covered by the pool cover 8. At the same time as the pool cover 8 is folded out, the pool cover 8 is fixed by locking on the top side of the pool border 9 by the fastening devices 17. Finally, the pool cover 8 is raised at the centre of the pool 2 by means of the locking device 13.

When uncovering the pool the different steps are made in an opposite order and direction, the loosening of the fastening devices 17 having to be started at the imagined terminal position of the pool cover.

Figure 7:
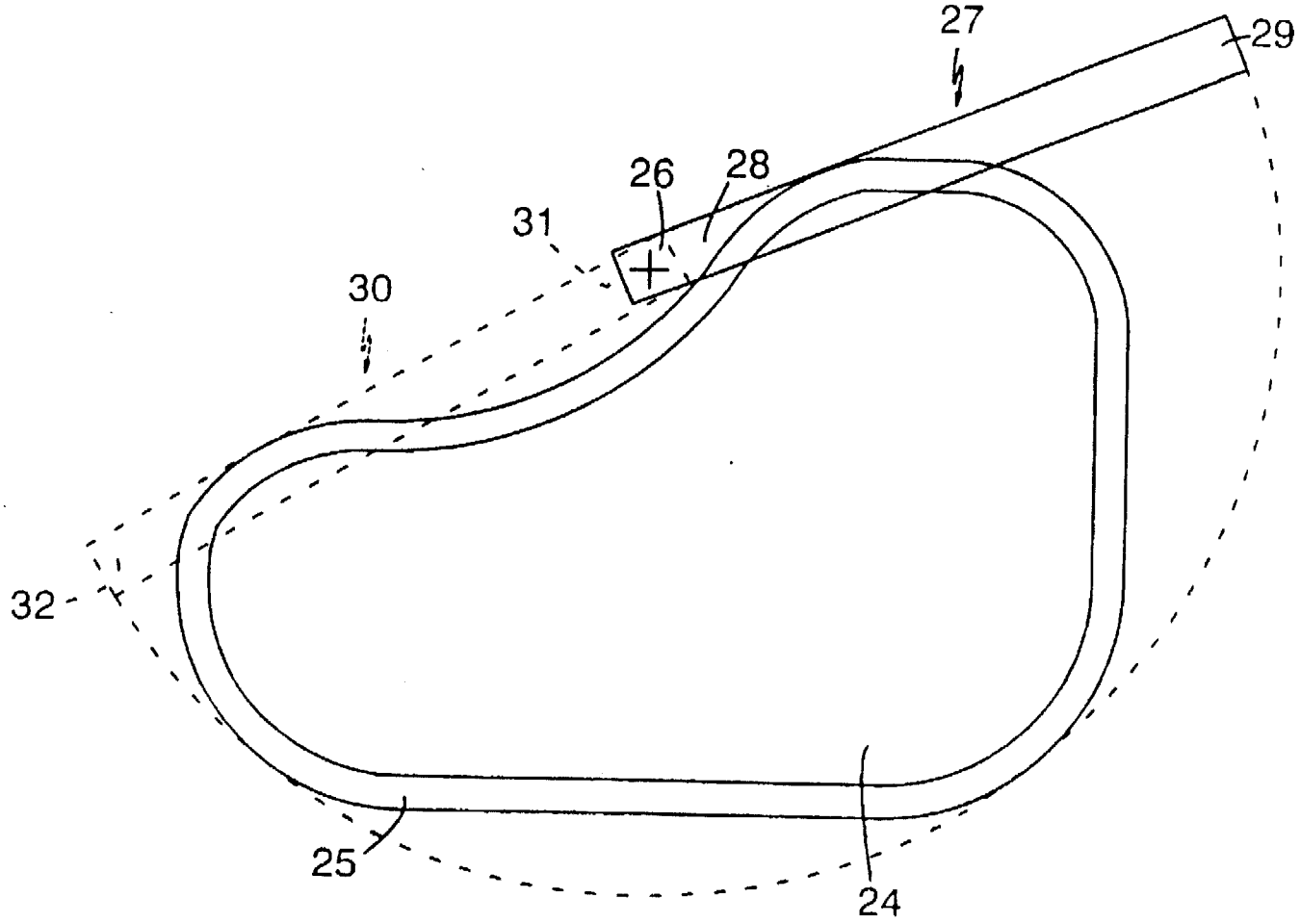
FIG. 7 shows a schematical illustration of a second embodiment of the pool cover.

In FIG. 7 is shown a schematical illustration of a second embodiment of the pool protection according to the invention. This embodiment is suitable to be used on pools having an unusual design, for instance kidney-shaped ones as in the figure.

Even the swimming pool 24 according to FIG. 7 has a surrounding pool border 25. Outside the pool edge is arranged a fundament (i.e., a base) 26 in which a first carrier 27, provided with two end portions 28, 29, is fastened and borne. In this connection, the first end portion of the carrier 27 is arranged in the fundament 26. A second carrier 30, provided with two end portions 31, 32, is pivotally journalled with its one end portion 31 at the first end portion 28 of the first carrier so that the second carrier 30 can be pivoted out in relation to the first carrier 27.

In the same way as in the first embodiment, this second embodiment is intended to comprise a pool cover provided with two end portions. The one end portion is intended to be connected to the first carrier 27, whereas the second end portion is intended to be connected to the second carrier 30. Due to that fact, the pool cover will cover the pool 24 when the second carrier 30 is pivoted out in relation to the first carrier 27.

In order to facilitate the movement of the second carrier 30 on the pool edge 25, the second carrier 30 is provided with elongated, movement-facilitating means which are directed in the longitudinal direction of the carrier. These means have such an extension that a part of the means will always be in contact with the edge 25 surrounding the pool 24.

The invention is of course not limited to the mentioned embodiments but can be modified within the scope of the following claims. The carriers of the end portions of the pool cover, for instance, can be in the same plane and accordingly be placed beside each other in an inactive position. Furthermore, the pool itself could be dug into the ground which would mean that no projecting border would be needed.

I claim:

1. A protection device for a pool which has an outer peripheral surrounding edge, comprising:

a base adapted to be located outside said surrounding edge of said pool;

a first, longitudinally elongated carrier having a first end and a second end;

a first support, by which said first end of said first carrier is mounted to and borne by said base;

a second, longitudinally elongated carrier having a first end and a second end;

a second support, by which said second end of said first carrier is pivotally mounted to said second end of said second carrier, for pivotal movement about a substantially vertical axis between a retracted position in which said first and second carriers are located adjacent one another and are generally aligned, and an extended position in which a substantial angle is included between said first and second carriers;

a pool cover having two angularly opposite ends, including a first end connected to said first carrier so as to extend in a direction from the first to the second ends of said first carrier, and a second end connected to said second carrier so as to extend in a direction from the first to the second ends of said second carrier, so that as said second carrier is moved from said retracted position to said extended position, said pool cover is extended, for covering at least a portion of the pool and as said second carrier is moved from said extended position to said retracted position, said pool cover is retracted, for uncovering at least a portion of the pool; and a movement-facilitating structure which is elongated lengthwise of said second carrier, mounted to said second carrier, and arranged to continually support said first end of said second carrier on said surrounding edge of said pool when said second carrier is in said retracted position, when said second carrier is in said extended position, and when said second carrier is being moved between said retracted and extended positions.

2. The pool protection device of claim 1, wherein:

said first support includes a substantially vertical axis pivot shaft which enables pivotal movement of the first and second carriers and the pool cover, when said second support is in said retracted position, between an active position in which said second ends of said first and second carriers are located more centrally of the pool, and an inactive position in which said second ends of said first and second carriers are located more peripherally of the pool.

3. The pool protection device of claim 2, wherein:

said first and second carriers respectively constitute an upper part and a lower part of a cassette, for containing said pool cover when said second carrier is in said retracted position.

4. The pool protection device of claim 3, further including:

a lockable and unlockable lock between said first ends of said first and second carriers, which, when locked when said second carrier is in said retracted position facilitates pivoting of said cassette between said active and inactive positions, and which when locked when said carrier is in said extended position prevents retraction of said second carrier from said extended position.

5. The pool protection device of claim 4, wherein:

said first support includes a horizontal axis hinged connection of said first end of said first carrier to said first support; and said lock is arranged to cause said first carrier to pivot second-end-upwards about said hinged connection when said lock is changed from being unlocked to being locked and said second carrier is in said extended position.

6. The pool protection device of claim 2, wherein:

said movement-facilitating structure includes at least one roller mounted for rotation about a generally horizontal axis.

7. The pool protection device of claim 1, wherein:

said pool cover has an outer perimetrical edge extending between said first ends of said first and second carriers; and said pool cover, at said outer perimetrical edge thereof, has mounted thereto a plurality of fastening devices spaced from one another along said outer perimetrical edge and arranged for fastening said pool cover, about said outer perimetrical edge, to the pool at the outer peripheral surrounding edge of the pool.

8. The pool protection device of claim 7, wherein:

each said fastening device includes a first part fastened to the pool cover, a second part arranged to be hooked into the outer peripheral surrounding edge of the pool, and a spring-loaded connector between said first and second parts for tending to urge said first and second parts towards one another.

* * * * *